US006088847A

United States Patent [19]

Burrow

[11] Patent Number: 6,088,847

[45] **Date of Patent: *Jul. 18, 2000**

[54] MOVEABLE BATHING SEAT

[76] Inventor: Albert A. Burrow, 2101 Shoreline Dr. #212, Alameda, Calif. 94501

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,795

[22] Filed: Aug. 12, 1997

[51] Int. Cl.[7] ..... A47K 3/12

[52] U.S. Cl. ..... 4/579; 4/578.1; 297/344.24; 297/344.26

[58] Field of Search ..... 4/559–562.1, 578.1, 4/579, 611, 604; 297/344.24, 344.26

[56] References Cited

U.S. PATENT DOCUMENTS

| | | | |
|---|---|---|---|
| 2,063,674 | 12/1936 | Hendrickson et al. | 297/344.26 |
| 2,237,076 | 4/1941 | Kenney et al. | 4/579 |
| 3,718,365 | 2/1973 | Gibson | 4/579 |
| 4,091,479 | 5/1978 | Hancock | 4/560.1 |
| 4,168,549 | 9/1979 | Davies | 4/578.1 |
| 4,941,218 | 7/1990 | McCartney | 4/579 |
| 5,364,163 | 11/1994 | Hardison | 297/344.26 |
| 5,390,378 | 2/1995 | Kanisch | 4/578.1 |
| 5,558,022 | 9/1996 | Mason et al. | 4/560.1 |
| 5,740,563 | 4/1998 | Gaddy | 4/579 |

FOREIGN PATENT DOCUMENTS

| | | | |
|---|---|---|---|
| 14 | of 1915 | United Kingdom | 4/579 |

*Primary Examiner*—Charles R. Eloshway
*Attorney, Agent, or Firm*—Brian Beverly

[57] ABSTRACT

An improved seat structure for assisting physically impaired individuals to bathe, including rectangular base which supports a seat. The seat is attached to a swivel which slides on tracks providing linear and rotary moveability. The base is affixed to adjoining walls of an existing bathtub enclosure by channels and fasteners.

5 Claims, 3 Drawing Sheets

MOVEABLE BATHING SEAT

BACKGROUND OF THE INVENTION

1. Field of the Invention

This invention relates to a seat to facilitate the bathing of individuals of limited physical ability in a bathtub or other bathing enclosure. More particularly, the invention relates to a lightweight bathing seat of simple and durable construction which can easily be secured on or removed from a bathtub, and which allows a person of limited physical mobility to move in and out of the bathtub enclosure with ease. In its preferred embodiment, the invention makes maximum use of the low coefficient of friction of high-density polyethylene in its construction to facilitate movement of the bathing seat toward and away from the entry side of a bathtub.

2. Description of the Prior Art

A number of bathing seats have been developed to assist persons with limited physical mobility or ability with bathing in a bathing enclosure, such as a bathtub or shower. These include bathing seats which extend from the bathing enclosure into the bathroom itself, such as Davies, U.S. Pat. No. 4,168,549, and Hancock, U.S. Pat. No. 4,091,479. These structures have the disadvantage of taking up bathroom space which is at a premium in many modern homes. Other bathing seats provide a chair or platform mounted on a supporting structure which is set on top of a bathtub. These structures rely on gravity to hold them in place while in use and are, or are perceived to be, less stable than seat structures which are fixed in place. See, for example, Kenney, U.S. Pat. No. 2,237,076, and Davies, supra. Still other bathing seats have been provided which are permanently mounted in place, thereby effectively dedicating use of the bathing facility to persons bathing with assistance of the seat.

Most prior art bathing seats are constructed of specially fabricated or bulky parts, which may require expensive tooling and set-up costs for manufacturing. See, for example, McCartney, U.S. Pat. No. 4,941,218, Hancock, supra, or Janisch, U.S. Pat. No. 5,390,378. No prior art or combination of prior art bathing seats provides a structure inexpensively constructed of lightweight and durable materials which provides a slidable and rotatable seat fitting within the confines of a bathing enclosure, that is easily installed and removed from the enclosure, and that safely and easily allows a person of limited physical mobility to move into and out of a bathing facility.

SUMMARY OF THE INVENTION

This invention provides a moveable bathing seat structure which facilitates easy and safe access to a bathtub or shower for bathing purposes for persons with physical limitations, either with or without assistance. The structure is designed to fit in a bathing recess, such as one for a bathtub, having three enclosure walls, entry being gained on fourth side where a temporary barrier, such as a shower curtain, may be provided at the entry-side face of the enclosure. A horizontal support surface is provided by a high-density polyethylene board which preferably sits on the back end of a bathtub. The polyethylene board rests on a back edge and on a side edge against two of the enclosure walls of the bathtub recess, is open on a tub-side edge to the bathtub, and extends on to an entry-side edge, but not beyond the entry-side face of the bathtub. The board is joined to the two enclosure walls with brackets.

A pair of spaced-apart rails are mounted on the top surface of the board and run perpendicular to the entry face of the bathtub. The rails each have channels which are in a facing relationship. A bucket seat, of the type having arms and a backrest, is provided and is mounted on a swivel assembly, allowing the seat to pivot around a vertical axis. The swivel assembly has a top portion which is joined to the bottom of the seat, and a bottom portion which is attached to the top portion and pivots in relation thereto. The bottom portion is provided with two edge runners which fit within the channels of the rails to allow the bottom portion, and hence the seat, to slide along the rails. The rails are preferably comprised of high-density polyethylene to take full advantage of its low coefficient of friction, thus allowing the runners of the bottom portion to slide easily in the channels without the need for wheels or lubrication. The rails extend a sufficient distance toward the side enclosure wall to allow the seat to slide from the entry-side face of the bathtub into a bathing position toward the middle of the support surface over the bathtub, allowing a person to move safely and easily in and out of a bathtub for bathing.

Accordingly, it is a primary object of the invention is to provide a moveable bathing seat for safely and easily moving a person of limited mobility into and out of a bathing enclosure for bathing.

A further object of the invention is to provide a moveable bathing seat of simple construction using a lightweight, durable material that is impervious to water.

Another object of the invention is to provide a bathing seat for disposition within a bathing enclosure for moving a person of limited physical ability into and out of a bathing enclosure.

A still further object of the invention is to provide a bathing seat for moving a person of limited physical ability into and out of a bathing enclosure, wherein the bathing seat is securely affixed to the bathing enclosure walls for enhanced stability of the seat.

Another object of the invention is to provide a moveable bathing seat having a set of rails with channels disposed in a mutually parallel spaced-apart facing relationship, and a seat having a swivel assembly comprising a bottom portion with oppositely disposed parallel edge runners which slidingly engage in the channels, the rails being comprised of high-density polyethylene having a low coefficient of friction thereby allowing the edge runners of the bottom portion of the swivel assembly to slide easily in the channels of the rails, for moving the seat into and out of a bathing enclosure.

Yet another object of the invention is to provide a moveable bathing seat for moving a person of limited physical ability into and out of a bathing enclosure which is easy and inexpensive to manufacture, and is easy to install and remove from a bathing enclosure.

DETAILED DESCRIPTION OF THE ILLUSTRATED EMBODIMENT

Figure 1:
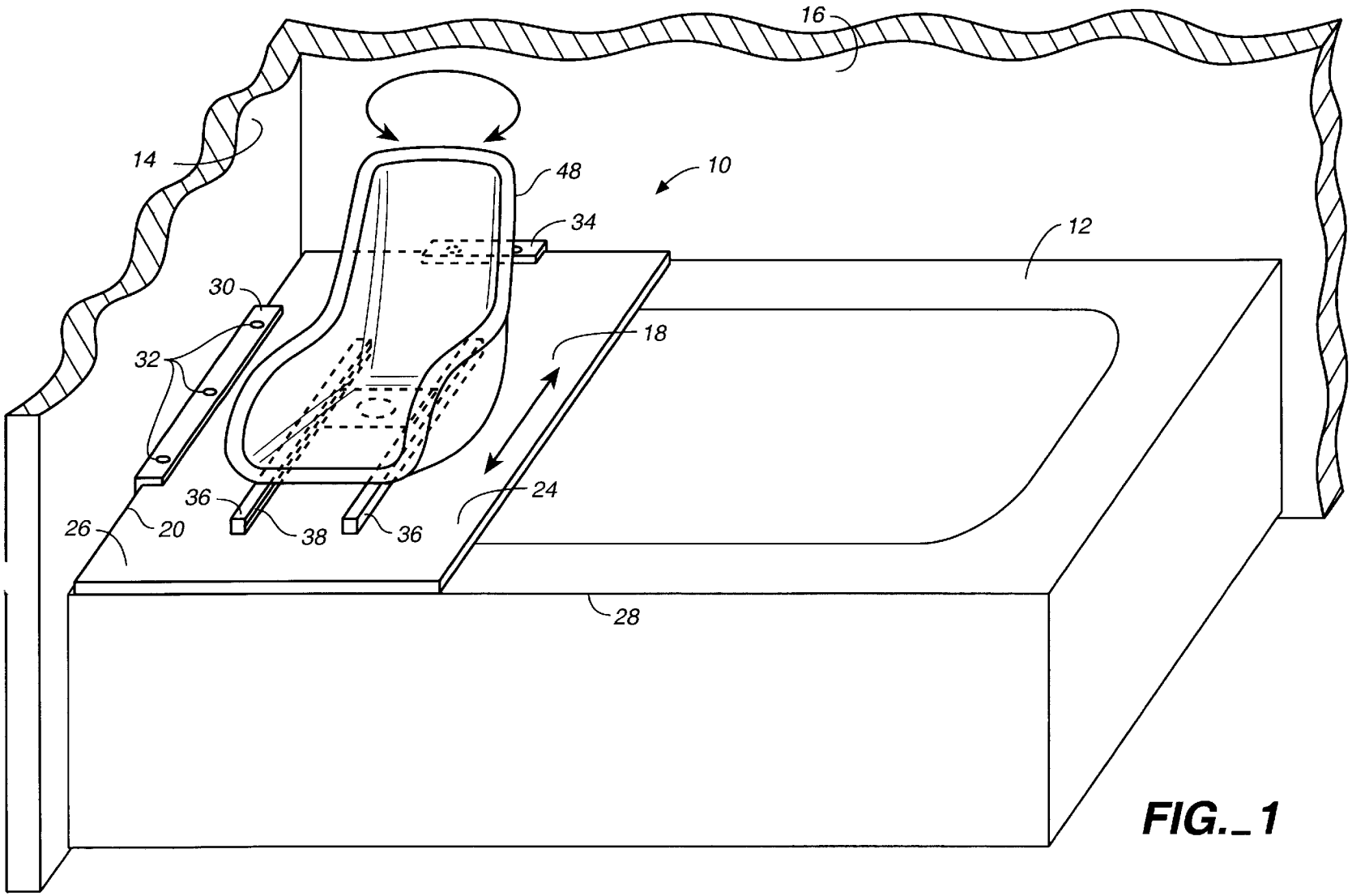
FIG. 1 is a perspective view of a moveable bathing seat according to the invention, shown placed on the backside of a bathtub in a bathing enclosure.

A moveable bathing seat 10 for safe and easy access to a bathtub or other bathing enclosure is shown generally in FIG. 1 resting on the back end of a bathtub 12 of the type having at least a back enclosure wall 14 and a side enclosure wall 16. A horizontal support surface 18 is disposed over the back end of the bathtub 12. A back edge 20 is aligned with the back enclosure wall 14 and a side edge 22 with the side enclosure wall 16. A tub-side edge 24 is open to the bathtub 12 and an entry-side edge 26 extends to the longitudinal leading edge 28 of the bathtub 12 on the entry side of the bathing enclosure. The support surface 18 thus is confined to the bathing enclosure leaving the bathroom proper for other uses. The horizontal support surface 18 is preferably supplied from a polyethylene board because of its impermeability to water, its strength, light weight, and ready commercial availability.

Figure 4:
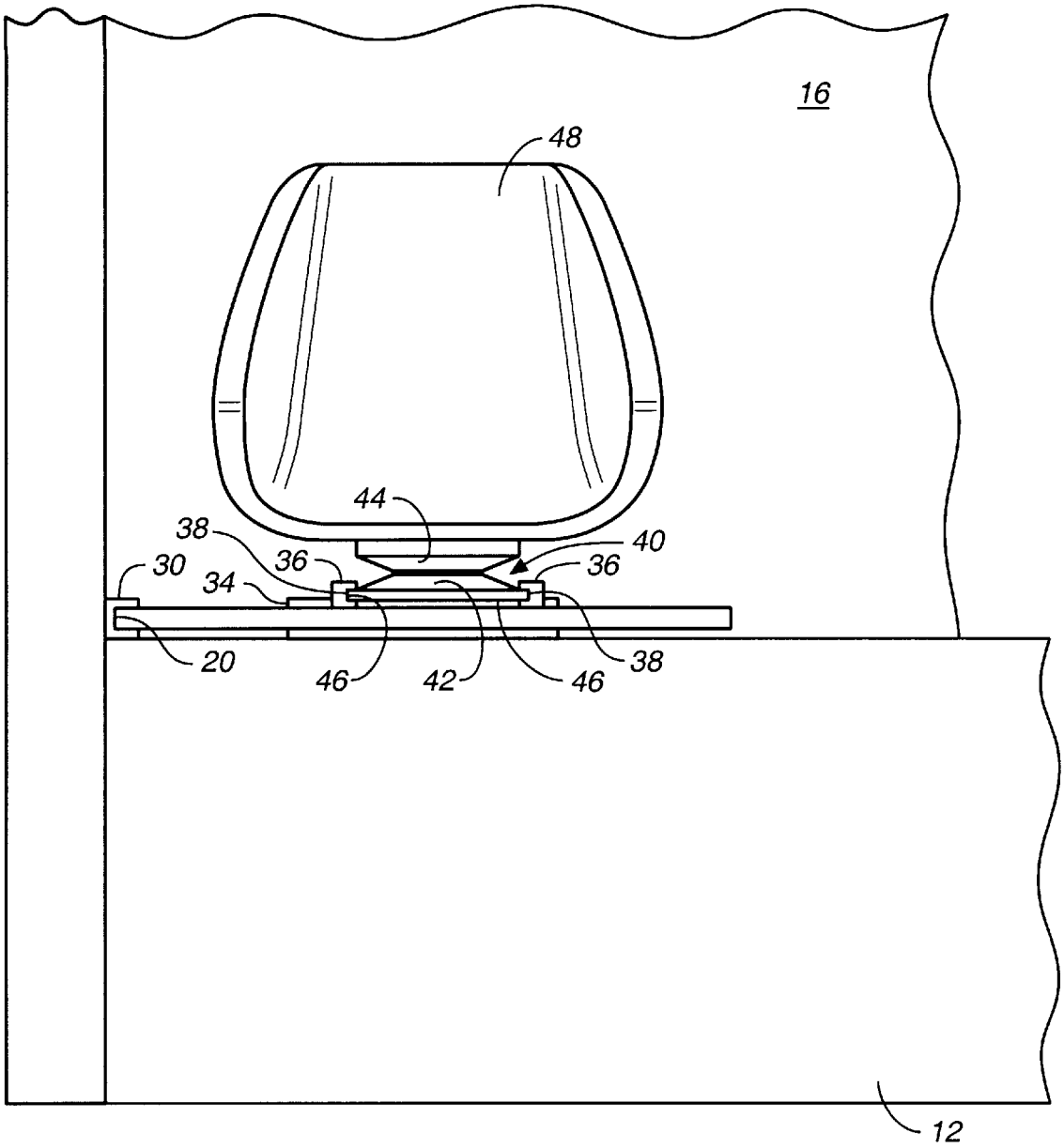
FIG. 4 is a side elevation view of the moveable bathing seat of FIG. 1.

A first bracket 30 is screwed to back enclosure wall 14. First bracket 30 is in turn affixed to the back edge 20 of the support surface 18 using commonly available fasteners 32 such as threaded fasteners. Similarly, second bracket 34 is screwed to side enclosure wall 16 and affixed to the side edge 22 of the support surface 18 with fasteners 32, preferably threaded fasteners. Threaded fasteners have been found to provide an advantageous compromise between secure fastening of the brackets to the support surface, on the one hand, and relatively quick and easy detachment of the brackets from the support surface when needed, on the other. The brackets 30, 34 are preferably constructed of aluminum. As best seen in FIG. 4, brackets 30, 34 are channel-shaped in cross-section and dimensioned for insertion of support surface 18 into them. Support surface 18 is thereby secured in place over the bathtub 12, but can quickly be removed by unfastening it from the brackets 30, 34. In actual operation, where threaded fasteners have been used, the support surface 18 can easily be unfastened from the brackets 30, 34, and the brackets 30, 34 from the walls, using, for example, an automatic screwdriver.

Figure 2:
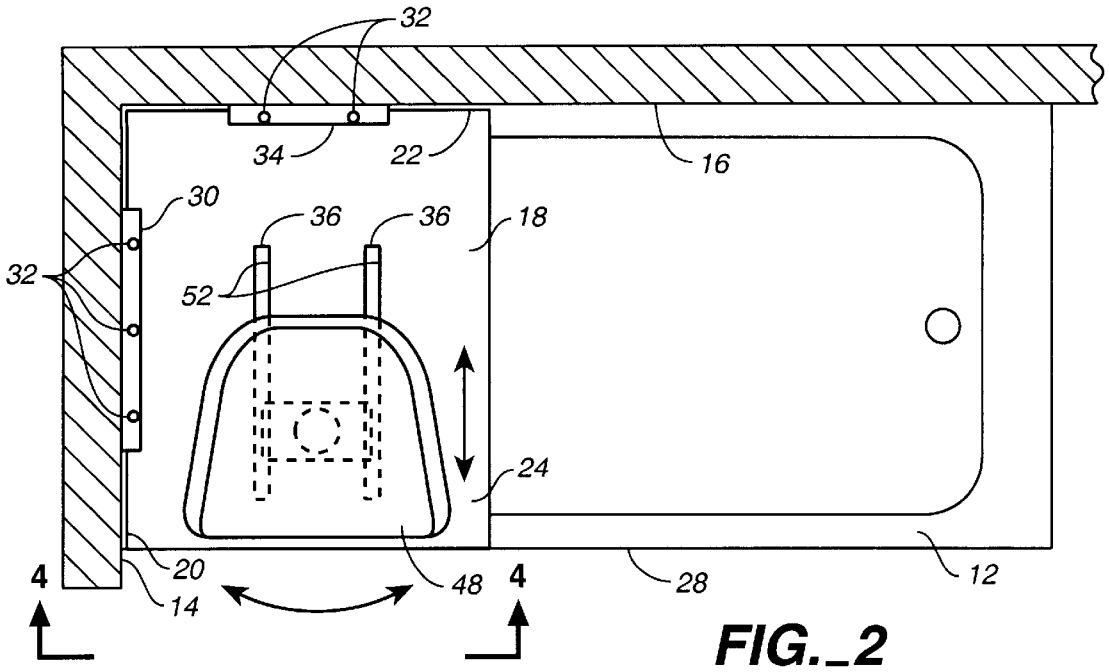
FIG. 2 is an overhead plan view of the moveable bathing seat of FIG. 1, showing the seat in a position adjacent to and pivoted toward the entry-side face of the bathtub.
Figure 3:
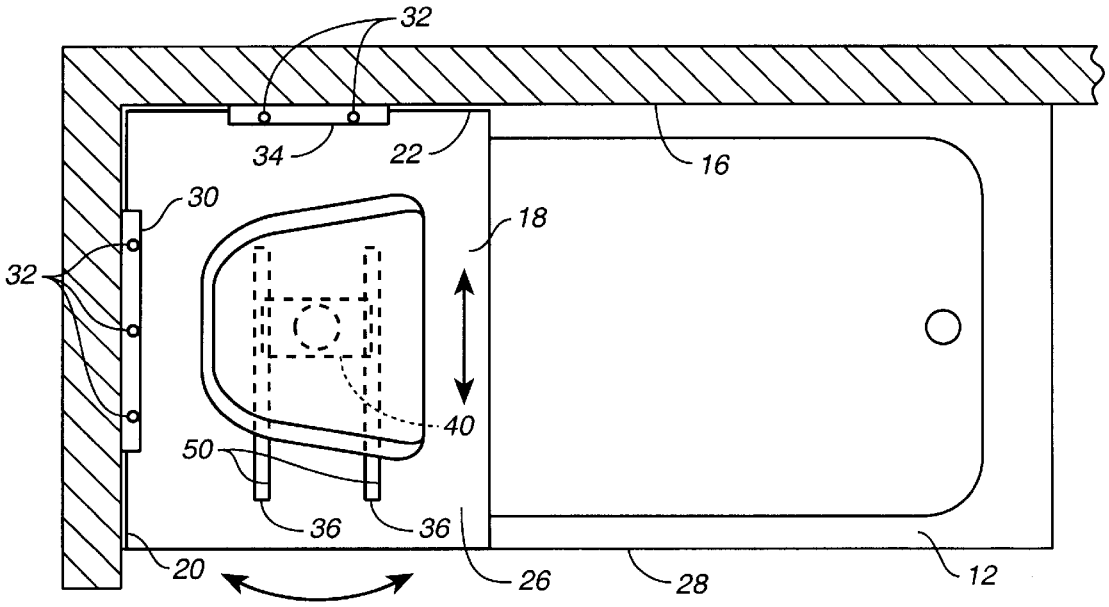
FIG. 3 is a plan view of the moveable bathing seat of FIG. 1, showing the seat moved to a position approximately toward the middle of and rotated toward the bathtub.

Referring generally to FIGS. 1–3, two parallel, spaced-apart rails 36 are bolted to the support surface 18. As best seen in FIG. 4, the inner side of each rail 36 has a channel 38, the channels 38 are cooperatively disposed in a parallel, facing relationship. The channels 38 extend the full length of the rails 36.

A swivel assembly 40, indicated generally in FIG. 4, is preferably comprised simply of a bottom portion 42 and a top portion 44 affixed, to the bottom portion 42 in pivoting relation thereto about a vertical axis. The bottom portion 42 extends downward and outwardly to form two oppositely disposed runners 46, best seen in FIGS. 2 and 3, which fit within the rail channels 38 thus rendering the swivel assembly 40 moveable linearly along the full length of the rails 36. It is highly preferable to construct the rails 36 from high-density polyethylene because the low coefficient of friction inherent in this material greatly facilitates sliding of the runners 46 of the bottom portion 42 of the swivel assembly 40 along the channels 38 of the rails 36. This eliminates the need to use wheels, other moving parts, or lubricants to make the swivel assembly 40 slidable. The rails 36 can be economically manufactured from high-density polyethylene which, once in actual use, will not deteriorate in a wet environment, is strong and light weight. In the preferred embodiment, it has been found that an off-the-shelf swivel assembly performs efficiently, making optional any special manufacture of a new swivel assembly for the invention.

In the illustrated embodiment, a "bucket-style" seat 48 is provided having arm rests and a back rest, but many other styles of seats could be substituted. The seat 48 is preferably comprised of polyurethane, which has the advantages of being durable, impermeable to water, strong, light weight, and readily commercially available. The seat 48 is mounted on the top portion 44 of the swivel assembly 40 allowing the seat 48 to rotate around a vertical axis. The rails 36 extend perpendicularly from one end 50 adjacent the longitudinal leading edge 28 of the bathtub 12 to another end 52 sufficiently approaching the side edge 22 of the support surface 18 to allow the seat 48 to slide from a position adjacent the leading edge 28 of the bathtub 12 to the middle part of the bathtub 12 for washing.

In normal operation, in preparation for bathing the seat 48 is slid adjacent the leading edge 28 of the bathtub 12 and rotated to face outward, allowing a person comfortably to sit in the seat 48. Once the person is seated, the seat 48 is slid back into a position over the bathtub 12. With assistance if needed, the person's feet and legs are lifted over the leading edge 28 of the bathtub leaving the person in a suitable position over the bathtub for bathing. When finished bathing, the entire process is reversed. The device operates within the confines of the bathing enclosure, freeing up valuable floor space in the bathroom proper and still enabling a person of limited physical mobility to safely and easily access a bathtub.

There have thus been described certain preferred embodiments of a moveable bathing seat. While preferred embodiments have been described and disclosed, it will be recognized by those with skill in the art that modifications are within the true spirit and scope of the invention. The appended claims are intended to cover all such modifications.

What is claimed is:

1. A moveable bathing seat for use in a bathtub enclosure having vertical walls, the moveable bathing seat comprising:

a horizontal surface, means for attaching said horizontal surface to the vertical walls of the bathtub enclosure, a seat, a swivel assembly for swivelling said seat about a vertical axis, said swivel assembly having a top portion fixed to said seat, and a bottom portion secured to said top portion in pivoting relation thereto, a pair of spaced-apart rails having a low coefficient of friction secured to said horizontal surface, each rail having a channel, said channels in facing relation, and said bottom portion of said swivel assembly having two oppositely disposed runners, said runners freely captured within said channels for horizontal sliding movement of said bottom portion along said channels of said rails, said coefficient of friction of said rails being sufficiently low to allow said runners to slide easily in said channels with the weight of a person on said seat, such that said seat is moveable rectilinearly along said horizontal surface.

2. The bathing seat of claim 1 wherein said channels each include:

an overhanging horizontal face, said horizontal faces limiting the upward movement of said runners of said bottom portion of said swivel assembly such that said seat is prevented from vertically tipping but remains freely moveable throughout the length of said channels.

3. The bathing seat of claim 1 wherein said rails comprise high-density polyethylene.

4. The bathing seat of claim 1 wherein said seat comprises:

a bucket seat having arms and a back rest.

5. A moveable bathing seat for use on a bathtub disposed within a bathing enclosure, the bathing enclosure having at least two enclosure walls, the bathtub having a back portion adjacent the two enclosure walls and an entry face, said bathing seat comprising:

a horizontal surface disposed over the back portion of the bathtub, said horizontal surface bounded on a back edge and on a side edge by enclosure walls of the bathing enclosure and on a entry-side edge by the entry face of the bathtub, said horizontal surface open on a tub-side edge to the bathtub, a first U-shaped bracket secured to said back edge of said horizontal surface and a second U-shaped bracket secured to said side edge of said horizontal surface, each said bracket adapted to be affixed to a wall of the bathing enclosure, a bucket seat having arms and a back rest, a pair of spaced-apart rails having a low coefficient of friction secured to said horizontal surface, each rail having a channel, said channels in facing relation, and a swivel assembly having a top portion fixed to said seat, and a unitary bottom portion secured to said top portion in pivoting relation thereto, said bottom portion of said swivel assembly having two oppositely disposed runners, said runners freely captured within said channels for horizontal movement of said bottom portion along said rails, said coefficient of friction of said rails being sufficiently low to allow said runners to slide easily in said channels with the weight of a person on said seat.

* * * * *